US007375830B2

(12) United States Patent
Angellier

(10) Patent No.: US 7,375,830 B2
(45) Date of Patent: May 20, 2008

(54) METHOD AND INSTRUMENT FOR MEASURING SEMICONDUCTOR WAFERS

(75) Inventor: Cedric Angellier, Meylan (FR)

(73) Assignee: S.O.I.Tec Silicon on Insulator Technologies, Bernin (FR)

( * ) Notice: Subject to any disclaimer, the term of this patent is extended or adjusted under 35 U.S.C. 154(b) by 0 days.

(21) Appl. No.: 11/748,179

(22) Filed: May 14, 2007

(65) Prior Publication Data

US 2007/0229812 A1 Oct. 4, 2007

Related U.S. Application Data

(63) Continuation of application No. PCT/FR2005/050948, filed on Nov. 15, 2005.

(30) Foreign Application Priority Data

Nov. 15, 2004 (FR) ..... 04 12064

(51) Int. Cl.
*G01B 11/28* (2006.01)

(52) U.S. Cl. ..... 356/630

(58) Field of Classification Search ..... None
See application file for complete search history.

(56) References Cited

U.S. PATENT DOCUMENTS 6,624,433 B2 * 9/2003 Okumura et al. ..... 250/548
6,954,269 B2 * 10/2005 Gaal et al. ..... 356/244
7,084,967 B2 * 8/2006 Nikoonahad et al. .... 356/237.2
2002/0193899 A1 12/2002 Shanmugasundram et al. .. 700/109

FOREIGN PATENT DOCUMENTS

JP 2004 012302 A 1/2004
WO WO 00/54325 9/2000

* cited by examiner

*Primary Examiner*—Tu T Nguyen
(74) *Attorney, Agent, or Firm*—Winston & Strawn LLP

(57) ABSTRACT

A method of measuring a circular wafer in which the surface (A) of the wafer is divided into a plurality (N) of concentric rings of constant surface area (A/N), and at least one measurement point ($P_n$) is positioned on each ring. The outside radius ($R_n$) of each ring is calculated using the following formula:

$$R_n = R_N (n/N)^{1/2}$$

in which n varies from 1 to N. In this manner, rings are obtained that become narrower with increasing distance from the center of the wafer, thereby providing measurement points that become closer together towards the edge of the wafer, and covering only the useful zone of the wafer to be measured, guaranteeing that no measurement is made in an annular exclusion zone.

21 Claims, 3 Drawing Sheets

METHOD AND INSTRUMENT FOR MEASURING SEMICONDUCTOR WAFERS

CROSS-REFERENCE TO RELATED APPLICATIONS

This application is a continuation of International application PCT/FR2005/050948 filed Nov. 15, 2005, the entire content of which is expressly incorporated herein by reference thereto.

BACKGROUND

The present invention relates to inspecting the quality of wafers each in the form of a thin cylindrical wafer of a semiconductor material such as silicon that undergoes a certain number of transformations (polishing, oxidation, implantation, transfer, depositing layers of materials, etc.) to form a support from which large numbers of components may be produced (for example, cells of integrated circuits or discrete devices).

Throughout the industrial process for producing such a wafer, its quality as regards the thickness, structure, number of defects, optical or electrical characteristics, etc. must be inspected regularly. To this end, methods exist for measuring magnitudes that can be used to carry out whole wafer mapping (electrical characteristics, thickness of a thin film, composition, etc). This mapping is carried out from measurement points, the number of which is necessarily limited by the acceptable duration of such inspections during the fabrication process. Thus, it is important to have methods which allow a minimum number of measurement points to be determined, and especially to determine a judicious positioning for them to represent the characteristics of the wafer to be measured in as faithful and efficient a manner as possible.

As an example, when inspecting the uniformity of the thickness of the thin silicon layer of a SOI (silicon-on-insulator) wafer obtained by the SMART-CUT® technique, the thickness of the thin layer after polishing (on the order of 20 nm to 1.5 μm) must take several factors into account:

Firstly, a high uniformity of thickness is desired over the whole wafer (on the order of several atomic planes), which requires great accuracy in the measurement. During the wafer fabrication process, polishing equipment is used. Because the layers in question are very thin, it will be understood that it is important to monitor and carefully adjust the operation of such equipment.

Further, the periphery of a SOI wafer has a zone termed an exclusion zone (up to 5 mm at the wafer circumference) where the measurements are not representative. This exclusion zone is actually larger than the unused peripheral zone of the wafer (for example zone not transferred after bonding typically 1 mm to 2 mm) to avoid measurement artifacts induced by the proximity of the wafer edge.

Certain measurements may be carried out "on-line", i.e. directly on the production line, while others are carried out "off-line", i.e. with measurement means that cannot be integrated into the production line, such as electrical measurements that can only be made off-line, for example.

Regarding "on-line" measurements, the polishing equipment includes metrological means (for example a reflectometer to measure thickness) with a capacity as regards the number of measurement points that is typically limited to about one hundred points per wafer, the measurement period being of the order of one second per point. Methods used to carry out wafer mapping are constituted by a distribution either along a diameter of the wafer, or in a circle, or by defining Cartesian coordinates for the measurement points. Those methods for positioning the measurement points are thus not adapted to measuring SOI wafers as the methods cannot, for example, permit a denser distribution of points close to the exclusion zone or suppression of the points in that zone.

Regarding "off-line" measurements, reflectometry equipment (for example measuring instrument such as "ACUMAP®" from ADE Semiconductor) produces a map that requires a large number of measurement points to obtain a faithful map of the uniformity of thickness of the thin layer: of the order of 7500 points for ACUMAP® equipment. Those measurements take a long time (about 2 to 3 minutes per wafer) and are thus expensive. For that reason, that type of inspection is generally carried out by sampling (i.e., off-line inspection, for example by analyzing one wafer per batch), which is not satisfactory. Further, off-line production inspection by sampling does not allow immediate corrective action to be carried out, which causes a loss of product during production.

This problem, discussed for the sake of clarification with the particular example of measuring thickness, is also applicable to measurements of electrical characteristics and more generally to any wafer characterization (thickness by ellipsometry, stress by Raman measurements, etc), especially of SOI wafers, where rapid and faithful mapping of a physical magnitude is required. A solution to this problem is needed, and is now provided by the present invention.

SUMMARY OF THE INVENTION

The invention provides a technical solution that can minimize the number of measurement points by judicious selection of the positions of these points on the wafer while ensuring representative mapping of the physical parameter to be inspected. This solution is achieved by a measurement method in which, in accordance with the present invention, the surface of the wafer is divided into a plurality of concentric rings of constant surface area and at least one measurement point is positioned on each ring.

Hence, the method of the invention can optimize positioning of the measurement points on a wafer to be inspected. By dividing it into a plurality of concentric rings of constant surface area, rings are obtained which become narrower with increasing distance from the center of the wafer, which means that the measurement points grow closer and closer together towards the edge of the wafer where the requirement for accuracy is greater. Further, dividing the wafer into concentric rings enables coverage to be restricted to only the useful zone of the wafer under inspection, and guarantees that no measurements are made in an annular exclusion zone.

Advantageously, the outside radius ($R_n$) of each ring is calculated from the following formula:

$$R_n = R_N (n/N)^{1/2}$$

in which n varies from 1 to N, N being the given number of measurement points and $R_N$ the inside radius of the exclusion zone.

In one particular embodiment of the invention, a single measurement point is positioned per ring, for example on the median radius. This allows a faithful wafer map to be produced of certain wafer characteristics or properties which, to a first approximation, have radial symmetry. Thickness is an example of one such property or characteristic of the wafer.

The measurement points may also be parameterized into polar coordinates to take rotational asymmetrical effects in the plane of the wafer into account. Each measurement point is angularly offset relative to the preceding measurement point. The value of the angular offset may be constant over the whole surface to be measured, or it may vary in zones containing groups of the rings. For a constant value, the angular offset value is about 100 degrees at least for measuring 300 mm SOI wafers. Similarly, the number of measurement points may vary from one ring zone to another, to favor certain zones, such as the periphery of the wafer, as regards the density of measurement points per unit surface area.

The measurement method described above is applicable to any type of wafer and in particular to wafers including an annular exclusion zone, which zone is not taken into account when dividing the useful surface to be measured into rings. These wafers may be wafers of semiconductor material such as silicon-on-insulator (SOI) wafers.

The method of the invention may in particular be used for measurements of a wafer property or characteristic, such as thickness, electrical characteristics, or stresses. The method then also includes respective steps of measuring the thickness, the electrical characteristics, or the stress at each positioned measurement point.

The present invention also provides an instrument for measuring a circular wafer, comprising measurement means such as wafer property or wafer characteristic measurement devices responding to programmable positioning control members (for example, a microprocessor) to carry out measurements at a plurality of predetermined points on the wafer. The control members include means for defining a plurality of concentric rings of constant surface area on the surface of the wafer to be measured and for positioning the measurement devices so that they carry out at least one measurement in each ring. When a constant angular offset is used, its value is about 100 degrees, at least for measuring 300 mm SOI wafers.

For the positioning control members, the outside radius ($R_n$) of each ring is determined from the following formula:

$$R_n=R_N(n/N)^{1/2}$$

in which n varies from 1 to N, N being the given number of measurement points and RN the inside radius of the exclusion zone.

As described above, the positioning control processing members include means for carrying out a single measurement per ring, for example on the median radius. The members also include means for applying an angular offset to each measurement point, relative to the preceding measurement point, which is identical over the whole of the surface area to be measured, or which differs according to zones defined by rings.

The command members also include means for defining an annular exclusion zone on the circular wafer which is not taken into account in the surface area of the wafer to be measured.

The measurement means of the instrument may in particular be means in the form of devices for measuring the thickness, electrical characteristics or stress. For this, the measuring device comprises an ellipsometer for measuring thickness, a density interface trap for measuring electrical characteristics by a pseudo-MOS or DIT-technique, a Raman-spectroscope, X-ray diffraction device or photoreflector device for measuring stress, or an atomic force microscope for measuring roughness.

BRIEF DESCRIPTION OF THE DRAWINGS

Other characteristics and advantages of the invention become apparent from the following description of particular implementations of the invention, given by way of non-limiting example, and made with reference to the accompanying drawings in which.

DETAILED DESCRIPTION OF THE PREFERRED EMBODIMENTS

Figure 1:
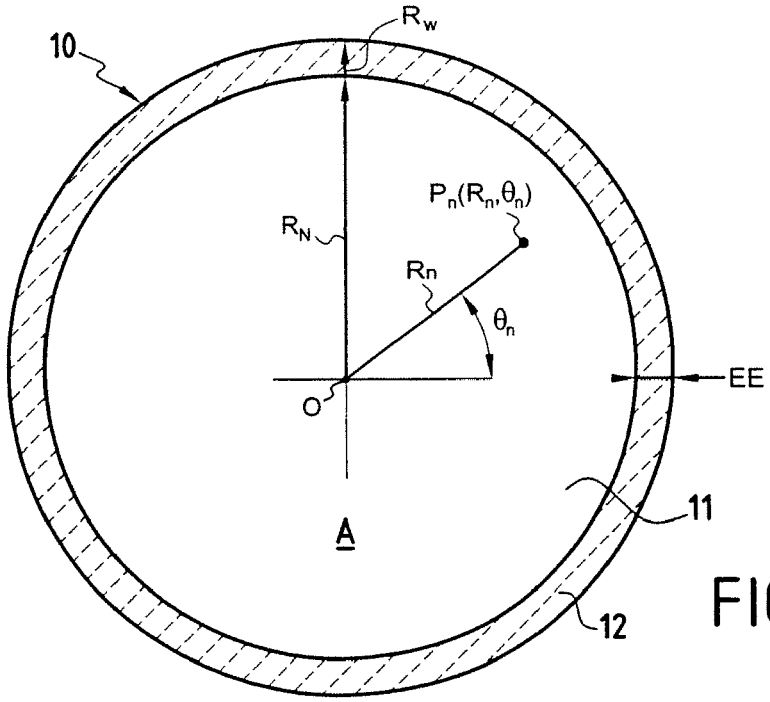
FIG. 1 is a diagrammatic view of a wafer illustrating the method employed to position the measurement points in accordance with one implementation of the invention.

The steps carried out to position measurement points in accordance with a method of the invention are described with reference to FIG. 1. FIG. 1 shows a wafer 10, such as an SOI wafer, which comprises a useful zone 11 to be measured and a peripheral exclusion zone 12. The useful zone 11 has a total area A.

In a first step, the zone 11 to be inspected is divided into a predetermined number N of concentric rings equal to the number of points to be measured. Further, the rings must have constant surface area S, such that S=A/N.

Let $R_n$ be the outside radius of a ring, and n a whole number varying from 1 to N, then the surface area $S_n$ of the wafer covered with this radius can be written as follows:

$$S_n=n\cdot R_n^2=n\cdot A/N \quad (1)$$

Since the area of the wafer to be measured does not include the exclusion zone 12 defined by a peripheral width EE, the outside radius RN of the ring adjacent to the zone 12 (i.e., the last ring N) is:

$$R_N=R_{W-EE}$$

where $R_W$= radius of wafer (see FIG. 1).

As a result, since the radius $R_N$ corresponds to the radius which allows the area A to be calculated (i.e. $A=n\cdot R_N^2$, the surface area $S_n$ can also be written:

$$S_n=n\cdot n\cdot R_N^2/N \quad (2)$$

Combining relationships (1) and (2) above, we obtain the equation of the variation of the outside radius $R_n$ of the rings:

$$R_n=R_N(n/N)^{1/2} \quad (3)$$

Once the N rings have been defined using relationship (3), at least one measurement point $P_n$ per ring is positioned radially, for example on the median radius of each ring, i.e., for a ring with outside radius $R_n$, on a radius $R'_n$ equal to $(R_{n+1}+R_n)/2$.

In accordance with the invention, the concentric rings all have the same surface area, which means that the rings grow closer and closer together with increasing distance from the center O, and they produce an increasing number of measurement points as the exclusion zone is approached. This mode of parameterization of the measurement points evenly weights a zone with low variability (i.e., less dense in measurement points) and a zone with high variability (i.e., more dense in measurement points) to maintain a proper overall value.

Dividing the area of the wafer to be measured into rings optimizes the measurement of the wafer, especially for inspecting its thickness. After polishing, the wafer profiles are essentially radially symmetrical, so that to a first approximation it may be considered that, on a given circle, the measurement of the thickness at any point thereof is representative of its entire circumference.

However, there may also be asymmetric longitudinal effects over the wafer. To take these asymmetrical effects into account, the measurement points may be disposed so as to be spaced apart successively from one another by a constant angle, in order to cover the total surface to be measured as well as possible.

As can be seen in FIG. 1, each measurement point $P_n$ is offset by an angular offset $\theta_n$ defined by the following relationship:

$$\theta_n=\theta_{n-1}+\Delta\theta$$

where $\Delta\theta$ is the increment of the angular offset, fixed at the outset at a greater or lesser value that depends on the weighting to be attributed to asymmetrical effects; $\theta_0$ may have any value.

The measurement points $P_n$ (varying from $P_1$ to $P_n$) are thus defined by the following polar coordinates:

$$P_n=(R'_n, \theta_n), \text{ in which n varies from 1 to N.}$$

For a relatively small angular offset increment $\Delta\theta$ (less than 10 degrees), the distribution of points on the surface to be measured takes the form of a spiral laid out on the surface of the wafer and is appropriate when radial variations are preponderant. For a larger angular offset $\Delta\theta$, this distribution of measurement points becomes more uniform and is more suitable when asymmetrical effects are important.

Figure 2:
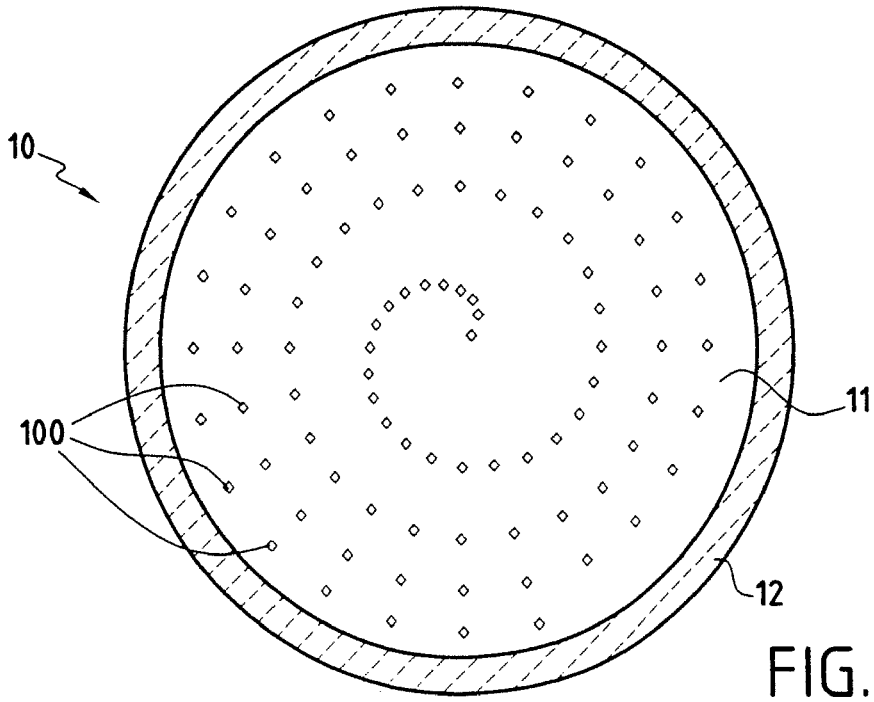
FIG. 2 illustrates a first example of a distribution of the measurement points over a wafer of the invention.

FIG. 2 shows an intermediate example of the distribution of measurement points, the parameterization being: number of points, N=89, and angular offset increment $\Delta\theta$=15 degrees. As explained above, with such a parameterization, measurement points 100 are obtained which form a spiral with a greater concentration at the limit of the exclusion zone 12.

Figure 3:
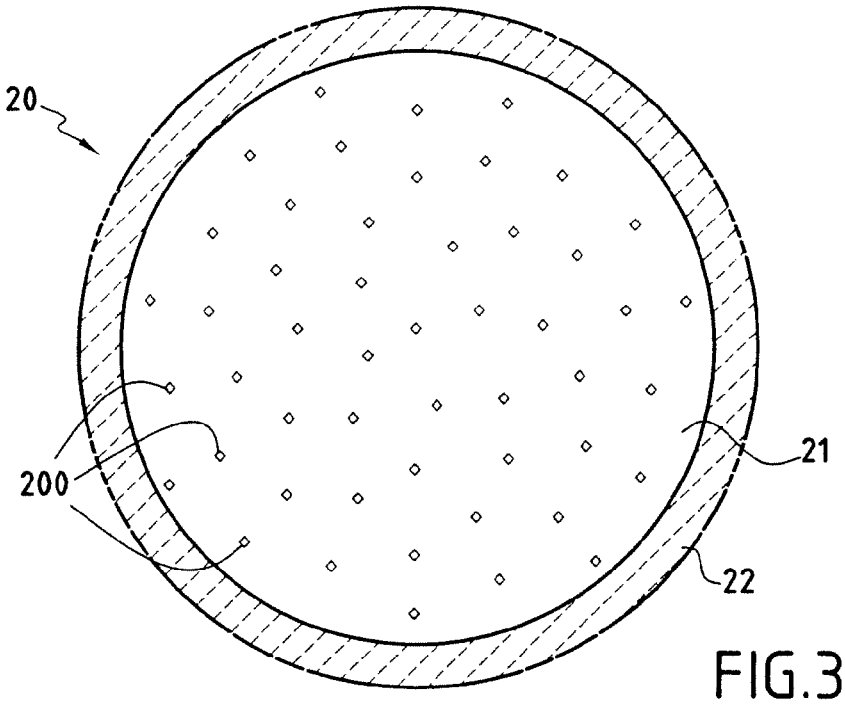
FIG. 3 illustrates a second example of a distribution of the measurement points over a wafer of the invention.

By way of example, FIG. 3 shows inspecting the thickness of the thin layer of a SOI wafer after polishing. An increment $\Delta\theta$ of 100 degrees, for a number N of measurement points 200 limited to 50, can produce a faithful map of the wafer. The method of the invention thus proposes a solution for optimizing the number and the positioning of the measurement points on a wafer which is particularly suitable for "on-line" measuring equipment, since the number of measurement points generally available on that type of equipment is of the order of one hundred.

The inventors sought to determine the influence of the offset angle on the faithfulness of the measurement. To this end, tests have been carried out on a plurality of wafers to determine the correlation coefficients between measurements of the thickness of 300 mm SOI wafers after polishing obtained using the following two methods:

by measurement with an ACUMAP® measurement instrument from ADE, the measurement being carried out on 7500 points; and using the method of the invention for a plurality of angles and different values of N.

It was observed at the end of these measurements that accuracy was high (i.e., there was a good correlation between the measurement of the invention and those carried out with the ACUMAP® measurement instrument) for an offset angle $\Delta\theta$ of the order of 100 degrees. In any event, the tests showed that the correlation obtained with an offset angle $\Delta\theta$ of the order of 100 degrees was much higher than that obtained when the angle was of the order of 15 degrees. The tests also showed that with the method of the invention, about fifty measurement points (N) was sufficient for the desired level of accuracy.

In a variation of the invention, the concentric rings may be grouped into a plurality of independent zones as regards their parameterization (i.e., the number of points in a ring and/or angular offset value), which is carried out as before. This allows the measurement points to be distributed in a manner more suited to the topology of the variations in the physical magnitude to be inspected (for example, as a function of the various pressure zones of the polishing head when inspecting thickness after polishing), and thus to minimize the number.

Figure 4A:
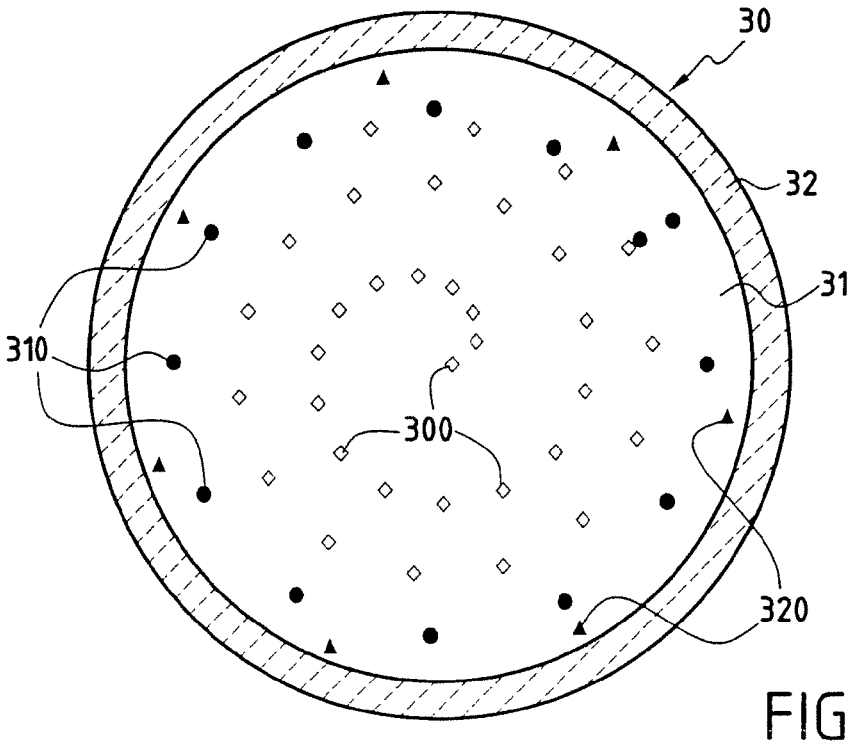
FIG. 4A illustrates a third example of a distribution of the measurement points over a wafer with three different zones, in each of which the angular offset is different.
Figure 4B:
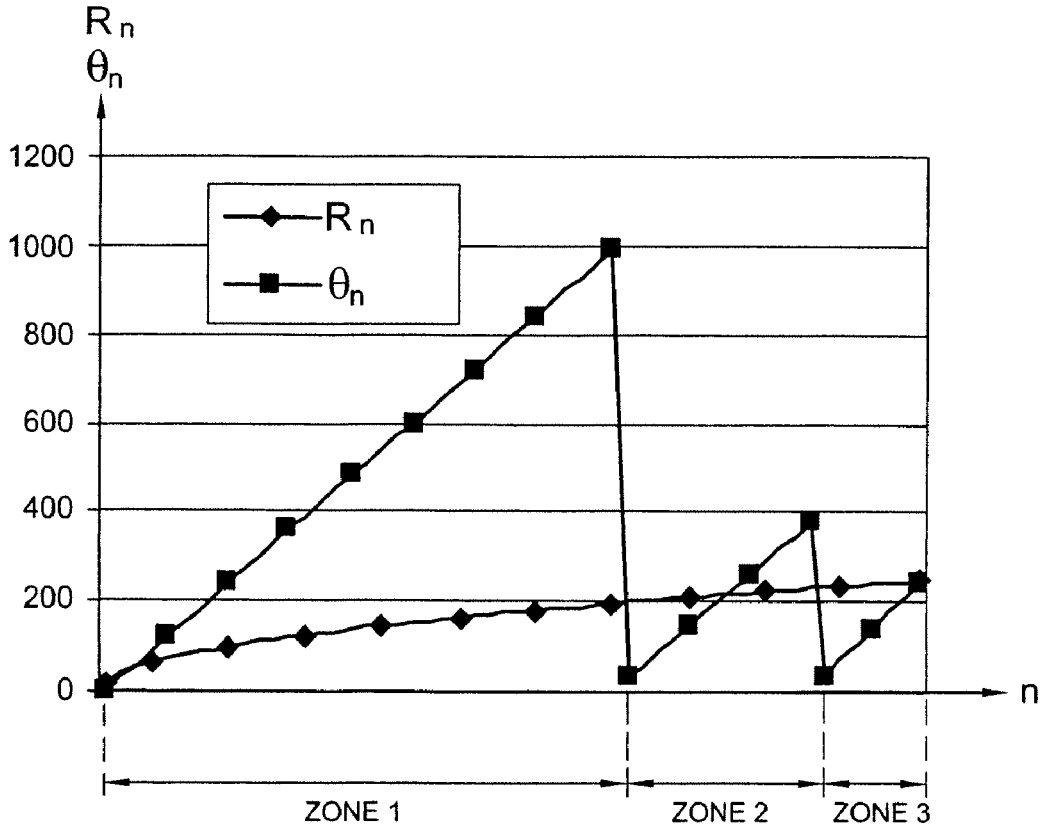
FIG. 4B is a graph showing the variations in the radius and the angular offset in the three zones of FIG. 4A.

FIG. 4A illustrates an example of the distribution of the measurement points over a wafer 30 into three independent zones: points 300 correspond to the measurement points disposed in accordance with a first parameterization in a first zone 1; points 310 correspond to measurement points disposed in accordance with a second parameterization in a second zone 2; and points 320 correspond to measurement points disposed in accordance with a third parameterization in a third zone 3. In FIG. 4B, which shows the change in the radius $R_n$ and the angle $\theta_n$ with the zones, it can be seen that only the angular offset varies from one zone to the other: for zone 1, $\Delta\theta$=25°, for zone 2, $\Delta\theta$=30° and for zone 3, $\Delta\theta$=50° (N=50).

In FIG. 4A, it can be seen that, in accordance with the positioning method of the invention, even when using independent zones, the measurement points are always included within the useful surface 31 of the wafer 30 without overflowing into the exclusion zone 32.

In a further variation of the invention, the parameterization of the measurement points is such that it allows several measurement points per ring to be positioned in accordance with a variable or fixed number for each ring, by optionally varying the angle $\theta_n$ and/or the radius $R_n$ for each point to be positioned.

Although described above for the purposes of simplification in relation to measuring the thickness of thin layers after polishing, the method is applicable to any cartographic measurement of a wafer (e.g., measurement of stress, electrical performance, uniformity of concentration, stress, roughness etc). For this, the measuring device comprises an ellipsometer for measuring thickness, a density interface trap for measuring electrical characteristics by a pseudo-MOS or DIT-technique, a Raman-spectroscope, X-ray diffraction device or photo-reflector device for measuring stress, or an atomic force microscope for measuring roughness.

The method described above is intended to be employed in the form of a computer program in metrological instrument used for the non-destructive inspection of wafers which use point measurements to produce a map which represents the whole of the wafer. Examples of the instrument concerned are instruments that can measure the thickness of a thin film of the wafer by reflectometry, such as a measuring instrument from Nova Measuring Instruments or Nanometrics, or by ellipsometry, such as the instrument from the "OPTIPROBE®" range sold by Thermawave.

In general, the present invention can be implemented in any type of wafer measuring instrument that has point-measuring tools such as a movable probe, or sensor, or an orientatable beam. In that type of instrument, it is well known that the measurement points are positioned by control members that principally comprise a programmable processor means such as a microprocessor that uses a positioning program to displace the measuring sensor or the like over all of the defined measurement points. Thus, the invention utilizes the combination of three means to implement the method, namely, means for dividing the surface of the wafer to be measured into a plurality of concentric rings of constant surface area and to position the measuring device to carry out at least one measurement in each ring; means for applying an angular offset to each measurement point, relative to the preceding measurement point, which is identical over the whole of the surface area to be measured, or which differs according to zones defined by rings; and means for defining an annular exclusion zone on the circular wafer which is not taken into account in the surface area of the wafer to be measured. These means typically comprise a computer or a control apparatus and, where necessary, the mechanical units, motors or actuators for positioning the measuring device. As a result, implementing the invention in that type of instrument only requires a modification to the positioning software, positioning of the measuring tools over the measurement points being computed from the positioning program corresponding to the method of the invention described herein.

What is claimed is:

1. A method of measuring a circular wafer, which comprises:

dividing the wafer surface (A) into a plurality (N) of concentric rings of constant surface area (A/N); and measuring the circular wafer by positioning at least one measurement point on each ring, wherein each ring has an outside radius ($R_n$) that is calculated using the following formula:

$$R_n=R_N(n/N)^{1/2}$$

in which n varies from 1 to N.

2. The method of claim 1, wherein the at least one measurement point is positioned on the median circle of the ring.

3. The method of claim 1, wherein each measurement point is angularly offset relative to the measurement point.

4. The method of claim 3, wherein the angular offset has a constant value over the entire surface to be inspected.

5. The method of claim 4, wherein the angular offset value is on the order of 100 degrees.

6. The method of claim 3, wherein the angular offset value differs in a plurality of zones defined by the rings.

7. The method of claim 1, wherein the number of measurement points differs in different zones defined by rings.

8. The method of claim 1, wherein the circular wafer includes an annular exclusion zone that is not taken into account during the dividing.

9. The method of claim 1, wherein the circular wafer is a wafer of semiconductor material.

10. The method of claim 9, wherein the circular wafer is a silicon-on-insulator wafer.

11. The method of claim 1, which further comprises measuring the thickness of the wafer at each positioned measurement point.

12. The method of claim 1, which further comprises measuring the electrical characteristics or stress at each positioned measurement point.

13. An instrument for measuring a circular wafer, comprising a measurement device responding to positioning control members to carry out a measurement at a plurality of predetermined points of the wafer, wherein the control members comprise means for dividing the surface of the wafer to be measured into a plurality of concentric rings of constant surface area and to position the measuring device to carry out at least one measurement in each ring, wherein each ring has an outside radius ($R_n$) that is calculated using the following formula:

$$R_n=R_N(n/N)^{1/2}$$

in which n varies from 1 to N.

14. The instrument of claim 13, wherein the measurement device carries out each measurement at a point on the median circle of each ring.

15. The instrument of claim 13, wherein the positioning control members further comprise means for applying an angular offset relative to the preceding measurement point to each measurement point.

16. The instrument of claim 13, wherein the value of the angular offset is constant.

17. The instrument of claim 16, wherein the value of the angular offset is on the order of 100 degrees.

18. The instrument of claim 13, wherein the value of the angular offset differs in different zones defined by rings.

19. The instrument of claim 13, wherein the number of measurement points differs in different zones defined by rings.

20. The instrument of claim 13, wherein the positioning control members further comprise means for defining an annular exclusion zone on the circular wafer, which zone is not included in the surface area of the wafer to be measured.

21. The instrument of claim 13, wherein measuring device comprises an ellipsometer for measuring thickness, a density interface trap for measuring electrical characteristics by a pseudo-MOS or DIT-technique, a Raman-spectroscope, X-ray diffraction device or photo-reflector device for measuring stress, or an atomic force microscope for measuring roughness.

* * * * *